US011521592B2

(12) United States Patent
Ping et al.

(10) Patent No.: US 11,521,592 B2
(45) Date of Patent: Dec. 6, 2022

(54) SMALL-FOOTPRINT FLOW-BASED MODELS FOR RAW AUDIO

(71) Applicant: Baidu USA, LLC, Sunnyvale, CA (US)

(72) Inventors: Wei Ping, Sunnyvale, CA (US); Kainan Peng, Sunnyvale, CA (US); Kexin Zhao, Santa Clara, CA (US); Zhao Song, Sunnyvale, CA (US)

(73) Assignee: Baidu USA LLC, Sunnyvale, CA (US)

( * ) Notice: Subject to any disclaimer, the term of this patent is extended or adjusted under 35 U.S.C. 154(b) by 0 days.

(21) Appl. No.: 16/986,166

(22) Filed: Aug. 5, 2020

(65) Prior Publication Data

US 2021/0090547 A1 Mar. 25, 2021

Related U.S. Application Data

(60) Provisional application No. 62/905,261, filed on Sep. 24, 2019.

(51) Int. Cl.
*G10L 25/30* (2013.01)
*G10L 13/02* (2013.01)

(52) U.S. Cl.
CPC ..... *G10L 13/02* (2013.01); *G10L 25/30* (2013.01)

(58) Field of Classification Search
CPC ..... G10L 25/30
USPC ..... 704/202
See application file for complete search history.

(56) References Cited

U.S. PATENT DOCUMENTS

2017/0033899 A1* 2/2017 Rakib ..... H04L 27/2655
2019/0392802 A1* 12/2019 Higurashi ..... G06N 3/0454
2020/0342857 A1* 10/2020 Moreno ..... G10L 15/20

OTHER PUBLICATIONS

Probability Density Distillation with Generative Adversarial Networks for High-Quality ParallelWaveform Generation Ryuichi Yamamoto1, Eunwoo Song2 and Jae-Min Kim2 (Year: 2019) (Year: 2019).*

(Continued)

*Primary Examiner* — Bharatkumar S Shah
(74) *Attorney, Agent, or Firm* — North Weber & Baugh LLP

(57) ABSTRACT

WaveFlow is a small-footprint generative flow for raw audio, which may be directly trained with maximum likelihood. WaveFlow handles the long-range structure of waveform with a dilated two-dimensional (2D) convolutional architecture, while modeling the local variations using expressive autoregressive functions. WaveFlow may provide a unified view of likelihood-based models for raw audio, including WaveNet and WaveGlow, which may be considered special cases. It generates high-fidelity speech, while synthesizing several orders of magnitude faster than existing systems since it uses only a few sequential steps to generate relatively long waveforms. WaveFlow significantly reduces the likelihood gap that has existed between autoregressive models and flow-based models for efficient synthesis. Its small footprint with 5.91M parameters makes it 15 times smaller than some existing models. WaveFlow can generate 22.05 kHz high-fidelity audio 42.6× faster than real-time on a V100 graphics processing units (GPU) without using engineered inference kernels.

20 Claims, 8 Drawing Sheets

(56) References Cited

OTHER PUBLICATIONS

E. Larson and S. Taulu, "Reducing Sensor Noise in MEG and EEG Recordings Using Oversampled Temporal Projection," in IEEE Transactions on Biomedical Engineering, vol. 65, No. 5, pp. 1002-1013, May 2018, doi: 10.1109/TBME.2017.2734641. (Year: 2018).*
Probability Density Distillation with Generative Adversarial Networks for High-Quality ParallelWaveform Generation Ryuichi Yamamoto1, Eunwoo Song2 and Jae-Min Kim2 (Year: 2019).*
E. Larson and S. Taulu, "Reducing Sensor Noise in MEG and EEG Recordings Using Oversampled Temporal Projection," in IEEE Transactions on Biomedical Engineering, vol. 65, No. 5, pp. 1002-1013, May 2018, doi: 10.1109/TBME.2017.2734641. (Year: 2018) (Year: 2018).*
Radford et al.,"Unsupervised representation learning with deep convolutional generative adversarial networks," arXiv preprint arXiv:1511.06434, 2016. (16pgs).
Ren et al.,"FastSpeech: Fast, robust and controllable text to speech," arXiv preprint arXiv:1905.09263, 2019. (13pgs).
Rezende et al.,"Variational inference with normalizing flows," arXiv preprint arXiv:1505.05770, 2016. (10pgs).
Ribeiro et al.,"CROWDMOS: An approach for crowdsourcing mean opinion score studies," In ICASSP, 2011. (4pgs).
Salimans et al.,"Weight normalization: A simple reparameterization to accelerate training of deep neural networks," arXiv preprint arXiv:1602.07868, 2016. (11pgs).
Serrà et al.,"Blow: a single-scale hyperconditioned flow for non-parallel raw-audio voice conversion," arXiv preprint arXiv:1906.00794, 2019. (17pgs).
Shen et al.,"Natural TTS synthesis by conditioning WaveNet on mel spectrogram predictions," arXiv preprint arXiv:1712.05884, 2018. (5pgs).
Sotelo et al.,"Char2wav: End-to-End Speech Synthesis," ICLR workshop, 2017. (6pgs).
Taigman et al.,"VoiceLoop: Voice fitting and synthesis via a phonological loop," arXiv preprint arXiv:1707.06588, 2018. (14pgs).
Tran et al.,"Discrete flows: Invertible generative models of discrete data," arXiv preprint arXiv:1905.10347, 2019. (11pgs).
Arik et al.,"Deep Voice: Real-time Neural Text-to-Speech," arXiv preprint arXiv:1702.07825, 2017. (17pgs).
Arik et al.,"Deep Voice 2: Multi-Speaker Neural Text-to-Speech," arXiv preprint arXiv:1705.08947, 2017. (15pgs).
Berg et al.,"Sylvester Normalizing Flows for Variational Inference," arXiv preprint arXiv:1803.05649, 2019. (12 pgs).
Binkowski et al.,"High fidelity speech synthesis with adversarial networks," arXiv preprint arXiv:1909.11646, 2019. (15pgs).
Brock et al.,"Large scale GAN training for high fidelity natural image synthesis," arXiv preprint arXiv:1809.11096, 2018. (35pgs).
Dieleman et al.,"The challenge of realistic music generation: modelling raw audio at scale," arXiv preprint arXiv:1806.10474, 2018. (13pgs).
Dinh et al.,"NICE: Non-linear independent components estimation," arXiv preprint arXiv:1410.8516, 2015. (13 pgs).
Dinh et al.,"Density estimation using Real NVP," arXiv preprint arXiv:1605.08803, 2017. (32pgs).
Donahue et al.,"Adversarial Audio Synthesis," arXiv preprint arXiv:1802.04208, 2019. (16pgs).
Ho et al.,"Flow++: Improving flow-based generative models with variational dequantization and architecture design," arXiv preprint arXiv:1902.00275, 2019. (16pgs).
Mehri et al.,"SampleRNN: An unconditional end-to-end neural audio generation model," arXiv preprint arXiv:1612.07837, 2017. (11pgs).
Menick et al.,"Generating high fidelity images with subscale pixel networks and multidimensional upscaling," arXiv preprint arXiv:1812.01608, 2018. (15pgs).
Paine et al."Fast wavenet generation algorithm," arXiv preprint arXiv:1611.09482, 2016. (6 pgs).
Papamakarios et al.,"Masked autoregressive flow for density estimation," arXiv preprint arXiv:1705.07057, 2018. (17pgs).
Peng et al.,"Parallel neural text-to-speech," arXiv preprint arXiv:1905.08459, 2019. (14pgs).
Pharris et al.,"NV-WaveNet: Better speech synthesis using gpu-enabled WaveNet inference," In NVIDIA Developer Blog, 2018, [online], [Retrieved Mar. 29, 2021]. Retrieved from Internet <URL: https://developer.nvidia.com/blog/nv-wavenet-gpu-speech-synthesis/> ( 11pgs).
Ping et al.,"Deep Voice 3: Scaling text-to-speech with convolutional sequence learning," arXiv preprint arXiv:1710.07654, 2018. (16pgs).
Ping et al.,"ClariNet: Parallel wave generation in end-to-end text-to-speech," arXiv preprint arXiv:1807.07281, 2019. (15pgs).
Prenger et al.,"WaveGlow: A flow-based generative network for speech synthesis," arXiv preprint arXiv:1811.00002, 2018. (5pgs).
Hoogeboom et al.,"Emerging convolutions for generative normalizing flows," arXiv preprint arXiv:1901.11137, 2019. (10 pgs).
Huang et al.,"Neural Autoregressive Flows," arXiv preprint arXiv:1804.00779, 2018. (16pgs).
K. Ito,"The LJ speech dataset," 2017, [online], [Retrieved Mar. 29, 2021], Retrieved from Internet <URL:https://keithito.com/LJ-Speech-Dataset/> (5pgs).
Kalchbrenner et al.,"Efficient neural audio synthesis," arXiv preprint arXiv:1802.08435, 2018. (10pgs).
Kim et al.,"FloWaveNet: A generative flow for raw audio," arXiv preprint arXiv:1811.02155, 2019. (9pgs).
Kingma et al.,"ADAM: A method for stochastic optimization," arXiv preprint arXiv:1412.6980, 2017. (15pgs).
Kingma et al.,"Glow: Generative flow with invertible 1 × 1 convolutions," arXiv preprint arXiv:1807.03039, 2018. (15pgs).
Kingma et al.,"Improving variational inference with inverse autoregressive flow," arXiv preprint arXiv:1606.04934, 2017. (16pgs).
Kumar et al.,"MelGAN: Generative Adversarial Networks forConditional Waveform Synthesis," arXiv preprint arXiv:1910.06711 , 2019. (14pgs).
Li et al.,"Neural speech synthesis with transformer network," arXiv preprint arXiv:1809.08895, 2019. (8pgs).
Sound demos for "WaveFlow: A Compact Flow-based Model for Raw Audio," [online], [Retrieved Mar. 29, 2021]. Retrieved from Internet <URL:https://waveflow-demo.github.io/> (1pg).
"NVIDIA/waveglow," [online], [Retrieved Mar. 29, 2021], Retrieved from Internet <URL:https://github.com/NVIDIA/waveglow> (2pgs).
Van den Oord et al.,"WaveNet: A generative model for raw audio," arXiv preprint arXiv:1609.03499, 2016.(15pgs).
Van den Oord et al.,"Conditional Image Generation withPixelCNN Decoders," arXiv preprint arXiv:1606.05328, 2016. (13pgs).
Van den Oord et al.,"Parallel WaveNet:Fast high-fidelity speech synthesis," arXiv preprint arXiv:1711.10433, 2017. (11pgs).
Wang, et al.,"Neural source-filterbased waveform model for statistical parametric speech synthesis," arXiv preprint arXiv:1810.11946, 2019. (11pgs).
Wang, et al.,"Tacotron: Towards end-to-end speech synthesis," arXiv preprint arXiv:1703.10135, 2017. (10pgs).
Yamamoto et al.,"Parallel wavegan:A fast waveform generation model based on generative adversarial networks with multi-resolution spectrogram," arXiv preprint arXiv:1910.11480, 2020. (5pgs).
Yamamoto et al.,"Probability density distillation with generative adversarial networks for highquality parallel waveform generation," arXiv preprint arXiv:1904.04472, 2019. (5 pgs).
Yu et al.,"Multi-scale context aggregation by dilated convolutions," arXiv preprint arXiv:1511.07122, 2016. (13pgs).

* cited by examiner

100

120

| | $x_1$ | $x_2$ | $x_3$ | $x_4$ | $x_5$ | $x_6$ | $x_7$ | $x_8$ |
|---|---|---|---|---|---|---|---|---|
| $z_1$ | 1 | | | | | | | |
| $z_2$ | | 1 | | | | | | |
| $z_3$ | | | 1 | | | | | |
| $z_4$ | | | | 1 | | | | |
| $z_5$ | | | | | $\sigma_5(x_{1:4})$ | | | |
| $z_6$ | | | | | | $\sigma_6(x_{1:4})$ | | |
| $z_7$ | | | | | | | $\sigma_7(x_{1:4})$ | |
| $z_8$ | | | | | | | | $\sigma_8(x_{1:4})$ |

FIG. 1B

SMALL-FOOTPRINT FLOW-BASED MODELS FOR RAW AUDIO

CROSS-REFERENCE TO RELATED APPLICATION

This patent application is related to and claims priority benefit under 35 USC § 119(e) to commonly-owned U.S. Pat. App. No. 62/905,261, filed on Sep. 24, 2019, entitled "COMPACT FLOW-BASED MODELS FOR RAW AUDIO," and listing Wei Ping, Kainan Peng, Kexin Zhao, and Zhao Song as inventors. Each document mentioned herein is incorporated by reference in its entirety and for all purposes.

BACKGROUND

The present disclosure relates generally to communication systems and machine learning. More particularly, the present disclosure relates to small-footprint flow-based models for raw audio.

Deep generative models have obtained noticeable successes for modeling raw audio in high-fidelity speech synthesis and music generation. Autoregressive models are among the best-performing generative models for raw waveforms, providing the highest likelihood scores and generating high-fidelity audios. One successful example is WaveNet, an autoregressive model for waveform synthesis, which operates at the high temporal resolution (e.g., 24 kHz) of raw audio and sequentially generates one-dimensional (1D) waveform samples at inference. As a result, WaveNet is prohibitively slow for speech synthesis and one has to develop highly engineered kernels for real-time inference, which is a requirement for most production text-to-speech (TTS) systems.

Accordingly, it is highly desirable to find new, more efficient generative models and methods that can generate faster high-fidelity audio without the need to resort to engineered inference kernels.

BRIEF DESCRIPTION OF THE DRAWINGS

References will be made to embodiments of the disclosure, examples of which may be illustrated in the accompanying figures. These figures are intended to be illustrative, not limiting. Although the accompanying disclosure is generally described in the context of these embodiments, it should be understood that it is not intended to limit the scope of the disclosure to these particular embodiments. Items in the figures may not be to scale.

FIG. 1B depicts the Jacobian of a bipartite transformation.

DETAILED DESCRIPTION OF EMBODIMENTS

Figure 1A:
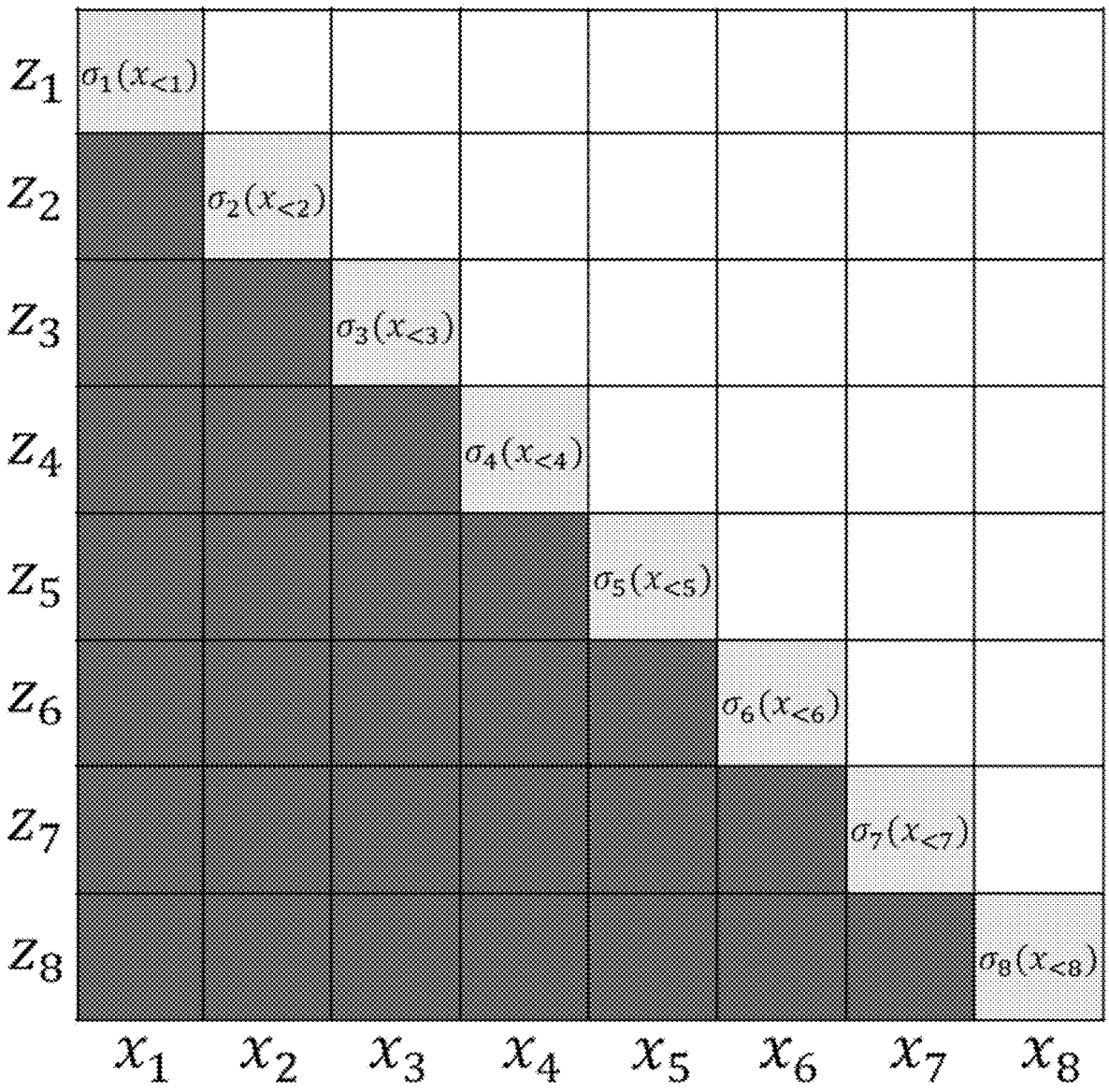
FIG. 1A ("FIG. 1A") depicts the Jacobian of an autoregressive transformation.

In the following description, for purposes of explanation, specific details are set forth in order to provide an understanding of the disclosure. It will be apparent, however, to one skilled in the art that the disclosure can be practiced without these details. Furthermore, one skilled in the art will recognize that embodiments of the present disclosure, described below, may be implemented in a variety of ways, such as a process, an apparatus, a system/device, or a method on a tangible computer-readable medium.

Components, or modules, shown in diagrams are illustrative of exemplary embodiments of the disclosure and are meant to avoid obscuring the disclosure. It shall also be understood that throughout this discussion that components may be described as separate functional units, which may comprise sub-units, but those skilled in the art will recognize that various components, or portions thereof, may be divided into separate components or may be integrated together, including, for example, being in a single system or component. It should be noted that functions or operations discussed herein may be implemented as components. Components may be implemented in software, hardware, or a combination thereof.

Furthermore, connections between components or systems within the figures are not intended to be limited to direct connections. Rather, data between these components may be modified, re-formatted, or otherwise changed by intermediary components. Also, additional or fewer connections may be used. It shall also be noted that the terms "coupled," "connected," "communicatively coupled," "interfacing," "interface," or any of their derivatives shall be understood to include direct connections, indirect connections through one or more intermediary devices, and wireless connections. It shall also be noted that any communication, such as a signal, response, reply, acknowledgement, message, query, etc., may comprise one or more exchanges of information.

Reference in the specification to "one or more embodiments," "preferred embodiment," "an embodiment," "embodiments," or the like means that a particular feature, structure, characteristic, or function described in connection with the embodiment is included in at least one embodiment of the disclosure and may be in more than one embodiment. Also, the appearances of the above-noted phrases in various places in the specification are not necessarily all referring to the same embodiment or embodiments.

The use of certain terms in various places in the specification is for illustration and should not be construed as limiting. The terms "include," "including," "comprise," and "comprising" shall be understood to be open terms and any examples are provided by way of illustration and shall not be used to limit the scope of this disclosure.

A service, function, or resource is not limited to a single service, function, or resource; usage of these terms may refer to a grouping of related services, functions, or resources, which may be distributed or aggregated. The use of memory, database, information base, data store, tables, hardware, cache, and the like may be used herein to refer to system component or components into which information may be entered or otherwise recorded. The terms "data," "information," along with similar terms may be replaced by other terminologies referring to a group of one or more bits, and may be used interchangeably. The terms "packet" or "frame" shall be understood to mean a group of one or more bits. The words "optimal," "optimize," "optimization," and the like refer to an improvement of an outcome or a process and do not require that the specified outcome or process has achieved an "optimal" or peak state.

It shall be noted that: (1) certain steps may optionally be performed; (2) steps may not be limited to the specific order set forth herein; (3) certain steps may be performed in different orders; and (4) certain steps may be done concurrently.

Any headings used herein are for organizational purposes only and shall not be used to limit the scope of the description or the claims. Each reference/document mentioned in this patent document is incorporated by reference herein in its entirety.

In one or more embodiments, a stop condition may include: (1) a set number of iterations have been performed; (2) an amount of processing time has been reached; (3) convergence (e.g., the difference between consecutive iterations is less than a first threshold value); (4) divergence (e.g., the performance deteriorates); and (5) an acceptable outcome has been reached.

It shall be noted that any experiments and results provided herein are provided by way of illustration and were performed under specific conditions using a specific embodiment or embodiments; accordingly, neither these experiments nor their results shall be used to limit the scope of the disclosure of the current patent document.

A. General Introduction

Flow-based models are a family of generative models, in which a simple initial density is transformed into a complex one by applying a series of invertible transformations. One group of models are based on autoregressive transformation, including autoregressive flow (AF) and inverse autoregressive flow (IAF) as the "dual" of each other. AF is analogous to autoregressive models, which performs parallel density evaluation and sequential synthesis. In contrast, IAF performs parallel synthesis but sequential density evaluation, making likelihood-based training very slow. Parallel WaveNet distills an IAF from a pretrained autoregressive WaveNet, which obtains the best of both worlds. However, one has to apply the Monte Carlo method to approximate the intractable Kullback-Leibler (KL) divergence in distillation. In contrast, ClariNet simplifies the probability density distillation by computing a regularized KL divergence in closed-form. Both of them require a pretrained WaveNet teacher and a set of auxiliary losses for high-fidelity synthesis, which complicates the training pipeline and increases the cost of development. As used herein, ClariNet refers to one or more embodiments in U.S. patent application Ser. No. 16/277,919, filed on Feb. 15, 2019, entitled "SYSTEMS AND METHODS FOR NEURAL TEXT-TO-SPEECH USING CONVOLUTIONAL SEQUENCE LEARNING," and listing Sercan Arik, Wei Ping, Kainan Peng, Sharan Narang, Ajay Kannan, Andrew Gibiansky, Jonathan Raiman, and John Miller as inventors.

Another group of flow-based models are based on bipartite transformation, which provide likelihood-based training and parallel synthesis. Most recently, WaveGlow and FloWaveNet apply Glow and RealNVP for waveform synthesis, respectively. However, the bipartite flows require more layers, larger hidden size, and huge number of parameters to reach comparable capacities as autoregressive models. In particular, WaveGlow and FloWaveNet have 87.88M and 182.64M parameters with 96 layers and 256 residual channels, respectively, whereas a typical 30-layer WaveNet has 4.57M parameters with 128 residual channels. Moreover, both of them squeeze the time-domain samples on the channel dimension before applying the bipartite transformation, which may lose the temporal order information and reduce efficiency at modeling waveform sequence.

In this patent document, one or more embodiments of a small-footprint flow-based model for raw audio may be referred to, generally, for convenience as "WaveFlow," which features i) simple training, ii) high-fidelity & ultra-fast synthesis, and iii) small footprint. Unlike Parallel WaveNet and ClariNet, various embodiments comprise training WaveFlow directly with maximum likelihood and without probability density distillation and auxiliary losses, which simplifies the training pipeline and reduces the cost of development. In one or more embodiments, WaveFlow squeezes the 1D waveform samples into a two-dimensional (2D) matrix and processes the local adjacent samples with autoregressive functions without losing temporal order information. Embodiments implement WaveFlow with a dilated 2D convolutional architecture, which leads to 15× fewer parameters and faster synthesis speed than WaveGlow.

In one or more embodiments, WaveFlow provides a unified view of likelihood-based models for raw audio, which includes both WaveNet and WaveGlow, which may be considered special cases, and allows one to explicitly trade inference parallelism for model capacity. Such models are systematically studied in terms of test likelihood and audio fidelity. Embodiments demonstrate that a moderate-sized WaveFlow may obtain comparable likelihood and synthesize high-fidelity speech as WaveNet, while synthesizing thousands of times faster. It is known that there exists a large likelihood gap between autoregressive models and flow-based models that provide efficient sampling.

In one or more embodiments, a WaveFlow embodiment may use, for example, 5.91M parameters by utilizing the compact autoregressive functions for modeling local signal variations. WaveFlow may synthesize 22.05 kHz high-fidelity speech, with Mean Opinion Score (MOS) 4.32, more than 40 times faster than real-time on a Nvidia V100 graphics processing units (GPU). In contrast, WaveGlow requires 87.88M parameters for generating high-fidelity speech. The small memory footprint is preferred in production TTS systems, especially for on-device deployment, where memory, power, and processing capabilities are limited.

B. Flow-Based Generative Models

Flow-based models transform a simple density p(z) (e.g., isotropic Gaussian) into a complex data distribution p(x) by applying a bijection x=f(z), where x and z are both n-dimensional. The probability density of x may be obtained through a change of variables using:

$$p(x) = p(z)\left|\det\left(\frac{\partial f^{-1}(x)}{\partial x}\right)\right|, \tag{1}$$

where $z=f^{-1}(x)$ is the inverse of the bijection, and det $$\left(\frac{\partial f^{-1}(x)}{\partial x}\right)$$

is the determinant of its Jacobian. In general, it takes $O(n^3)$ to compute the determinant, which is not scalable in high-dimension. There are two notable groups of flow-based models with triangular Jacobians and tractable determinants, which are based on autoregressive and bipartite transformations, respectively. A summary of model capacities and parallelisms of flow-based models is presented in Table 1.

1. Autoregressive Transformation

Autoregressive flow (AF) and inverse autoregressive flow (IAF) use autoregressive transformations. Specifically, AF defines $z=f^{-1}(x;\ \vartheta)$:

$$z_t=x_t\cdot\sigma_t(x_{<t};\vartheta)+\mu_t(x_{<t};\vartheta), \tag{2}$$

where the shifting variables $\mu_t(x_{<t};\vartheta)$ and scaling variables $\sigma_t(x_{<t};\vartheta)$ are modeled by an autoregressive architecture parameterized by $\vartheta$ (e.g., WaveNet). It is noted that the t-th variable $z_t$ depends only on $x_{\leq t}$, thus the Jacobian is a triangular matrix, as illustrated in FIG. 1A, which depicts the Jacobian $$\frac{\partial f^{-1}(x)}{\partial x}$$

of an autoregressive transformation. FIG. 1B depicts the Jacobian of a bipartite transformation. The blank cells are zeros and represent the independent relations between $z_i$ and $x_j$. The light gray cells with scaling variables a represent the linear dependencies. The dark gray cells represent complex non-linear dependencies.

The determinant of the Jacobian is the product of the diagonal entries:

$$\det\left(\frac{\partial f^{-1}(x)}{\partial x}\right)=\Pi_t\sigma_t(x_{<t};\ \vartheta).$$

The density p(x) may be evaluated in parallel by Eq. (1), because the minimum number of sequential operations is O(1) for computing $z=f^{-1}(x)$ (see Table 1). However, AF has to perform sequential synthesis, because x=f(z) is autoregressive:

$$x_t=\frac{z_t-\mu_t(x_{<t};\ \vartheta)}{\sigma_t(x_{<t};\ \vartheta)}.$$

It is noted that the Gaussian autoregressive model may be equivalently interpreted as an autoregressive flow.

In contrast, IAF uses an autoregressive transformation for inverse mapping $z=f^{-1}(x)$:

$$z_t=\frac{x_t-\mu_t(z_{<t};\ \vartheta)}{\sigma_t(z_{<t};\ \vartheta)}, \tag{3}$$

making density evaluation very slow for likelihood-based training, but one can sample x=f(z) in parallel through $x_t=z_t\cdot\sigma_t(z_{<t};\ \vartheta)+\mu_t(z_{<t};\ \vartheta)$. Parallel WaveNet and ClariNet are based on IAF for parallel synthesis, and they rely on the probability density distillation from a pretrained autoregressive WaveNet at training.

2. Bipartite Transformation

RealNVP and Glow use bipartite transformation by partitioning the data x into two groups $x_a$ and $x_b$, where the indices sets $a\cup b=\{1, \ldots, n\}$ and $a\cap b=\phi$. Then, the inverse mapping $z=f^{-1}(x,\ \theta)$ is defined as:

$$z_a=x_a, z_b=x_b\cdot\sigma_b(x_a;\theta)+\mu_b(x_a;\theta). \tag{4}$$

where the shifting variables $\mu_b(x_a;\ \theta)$ and scaling variables $\sigma_b(x_a;\ \theta)$ are modeled by a feed-forward neural network. Its Jacobian $$\frac{\partial f^{-1}(x)}{\partial x}$$

is a special triangular matrix as illustrated in FIG. 1B. By definition, x=f(z, θ) is, $$x_a=z_a,\ x_b=\frac{z_b-\mu_b(x_a;\ \theta)}{\sigma_b(x_a;\ \theta)} \tag{5}$$

It is noted that both evaluating $z=f^{-1}(x,\ \theta)$ and sampling x=f(z, θ) may be performed in parallel.

WaveGlow and FloWaveNet squeeze the time-domain samples on the channel dimension, then apply the bipartite transformation on the partitioned channels. Note that, this squeezing operation is inefficient, as one may lose the temporal order information. As a result, synthesized audio, for example, may have constant frequency noises.

TABLE 1

| Flow-based model | Sequential operations for $z=f^{-1}(x)$ | Sequential operations for x = f(z) | Model capacity (same size) |
|---|---|---|---|
| AF | O(1) | O(n) | high |
| IAF | O( n) | O(1) | high |
| Bipartite flow | O(1) | O(1) | low |
| WaveFlow | O(1) | O(h) | low ↔ high |

Table 1 illustrates the minimum number of sequential operations (which indicates parallelism) required by flow-based models for density evaluation $z=f^{-1}(x)$ and sampling x=f(z). In Table 1, n represents the length of x, and h represents the squeezed height in WaveFlow. In WaveFlow, a larger h may lead to higher model capacity at the expense of more sequential steps for sampling.

3. Connections

Autoregressive transformation is more expressive than bipartite transformation. As illustrated in FIG. 1A and FIG. 1B, autoregressive transformation introduces $$\frac{n\times(n-1)}{2}$$

complex non-linear dependencies (dark gray cells) and n linear dependencies between data x and latents z. In contrast, bipartite transformation has only $$\frac{n^2}{4}$$

non-linear dependencies and $$\frac{n}{2}$$

linear dependencies. Indeed, one can easily reduce an autoregressive transformation $z=f^{-1}(x, \vartheta)$ to a bipartite transformation $z=f^{1}(x, \theta)$ by: (i) picking an autoregressive order o, such that all indices in set a rank earlier than the indices in b, and (ii) setting the shifting and scaling variables as $$\begin{pmatrix} \mu_t(x_{<t}; \vartheta) \\ \sigma_t(x_{<t}; \vartheta) \end{pmatrix} = \begin{cases} (0, 1)^T, & \text{for } t \in a \\ (\mu_t(x_a; \theta), \sigma_t(x_a; \theta)^T, & \text{for } t \in b \end{cases}.$$

Given the less expressive building block, the bipartite flows require more layers and larger hidden size to reach the capacity of autoregressive model, e.g., as measured by likelihood.

The next section presents WaveFlow embodiments and implementation embodiments with dilated 2D convolutions. Permutation strategies for stacking multiple flows are also discussed.

C. WaveFlow Embodiments

1. Definition

Figure 2A:
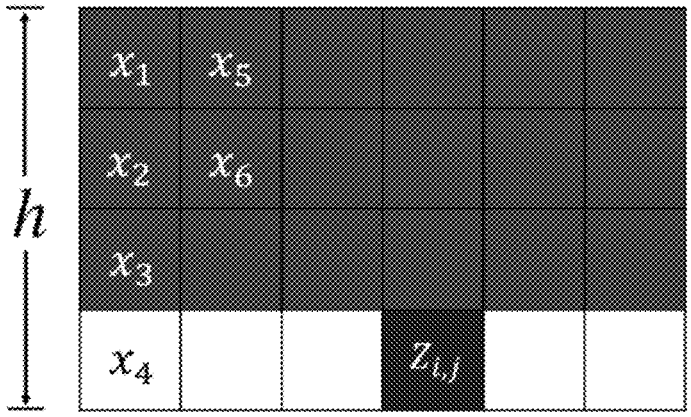
FIG. 2A depicts receptive fields over squeezed inputs X for computing $Z_{i,j}$ in WaveFlow, according to one or more embodiments of the present disclosure.
Figure 2B:
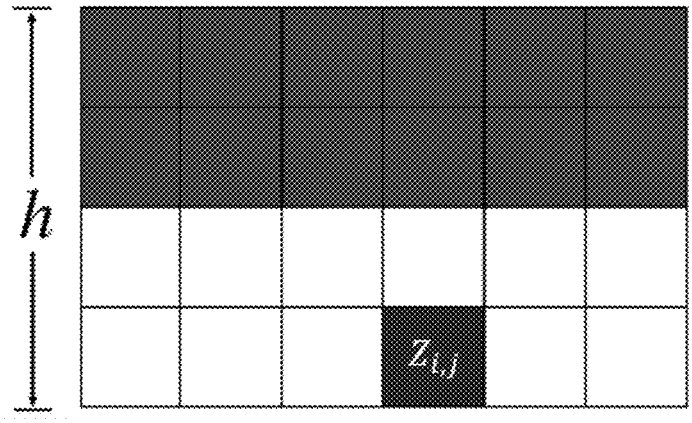
FIG. 2B depicts receptive fields over squeezed inputs X for computing $Z_{i,j}$ in WaveGlow.
Figure 2C:
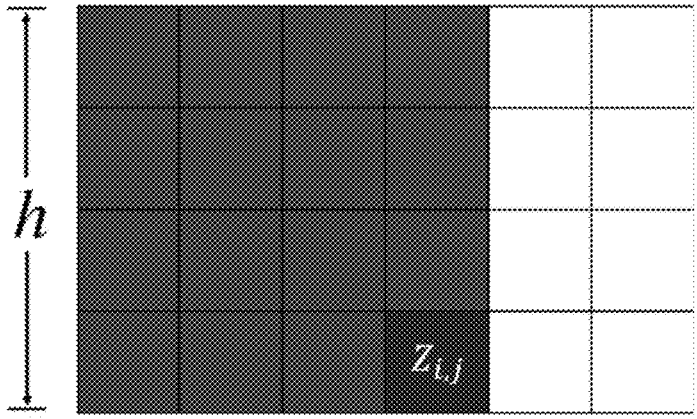
FIG. 2C depicts receptive fields over squeezed inputs X for computing $Z_{i,j}$ in autoregressive flow with column-major order.

Denoting a 1D waveform as $x=\{x_1, \ldots, x_n\}$, in one or more embodiments, x may be squeezed into an h-row 2D matrix $X \in \mathbb{R}^{h \times w}$ by column-major order, where adjacent samples are in the same column. It is assumed that $Z \in \mathbb{R}^{h \times w}$ are sampled from an isotropic Gaussian distribution, and $Z=f^{1}(X; \Theta)$ is defined as $$Z_{i,j}=\sigma_{i,j}(X_{<i,\cdot}:\Theta)\cdot X_{i,j}+\mu_{i,j}(X_{<i,\cdot}:\Theta), \tag{6}$$

where $X_{<i,\cdot}$ represents all elements above the i-th row, as illustrated in FIG. 2A-FIG. 2C, which depict the receptive fields over the squeezed inputs X for computing $Z_{i,j}$ in a WaveFlow embodiment (FIG. 2A), WaveGlow (FIG. 2B), and autoregressive flow with column-major order (e.g., WaveNet) (FIG. 2C).

It is noted that (i) in WaveFlow, the receptive field over the squeezed inputs X for computing $Z_{i,j}$ may be strictly larger than the receptive field of WaveGlow when h>2; (ii) WaveNet is equivalent to an autoregressive flow (AF) with the column-major order on X; and (iii) both WaveFlow and WaveGlow look at future waveform samples in original x for computing $Z_{i,j}$, whereas WaveNet cannot.

As discussed in Section C.2, in one or more embodiments, the shifting variables $\mu_{i,j}(X_{<i,\cdot}:\Theta)$ and scaling variables $\sigma_{i,j}(X_{<i,\cdot}:\Theta)$ in Eq. (6) may be modeled by a 2D convolutional neural network. By definition, the variable $Z_{i,j}$ depends only on the current $X_{i,j}$ and previous $X_{<i,\cdot}$ in raw-major order, thus the Jacobian is a triangular matrix and its determinant is:

$$\det\left(\frac{\partial f^{-1}(X)}{\partial X}\right) = \prod_{i=1}^{h}\prod_{j=1}^{w}\sigma_{i,j}(X_{<i,\cdot}; \Theta) \tag{7}$$

As a result, the log-likelihood may be calculated in parallel by change of variable in Eq. (1), $$\log_p(X) = \sum_{i,j}\left(\log \sigma_{i,j}(X_{<i,\cdot}; \Theta) - \frac{Z_{i,j}^2}{2} - \frac{1}{2}\log(2\pi)\right) \tag{8}$$

and maximum likelihood training may be performed efficiently. In one or more embodiments, at synthesis, Z may be sampled from the isotropic Gaussian, and forward mapping $X=f^{-1}(Z;\Theta)$ may be applied:

$$X_{i,j} = \frac{Z_{i,j} - \mu_{i,j}(X_{<i,\cdot}; \Theta)}{\sigma_{i,j}(X_{<i,\cdot}; \Theta)} \tag{9}$$

which is autoregressive over the height dimension and uses h sequential steps to generate the whole X. In one or more embodiments, a relatively small h (e.g., 8 or 16) may be used. As a result, relatively long waveforms may be generated within a few sequential steps.

2. Implementation with Dilated 2D Convolutions

In one or more embodiments, WaveFlow may be implemented with a dilated 2D convolutional architecture. For example, a stack of 2D convolution layers may be used (e.g., 8 layers were used in experiments) to model the shifting variables $\mu_{i,j}(X_{<i,\cdot}:\Theta)$ and scaling variables $\sigma_{i,j}(X_{<i,\cdot}:\Theta)$ in Eq. (6). Various embodiments use an architecture similar to WaveNet but replace the dilated 1D convolution with a 2D convolution, while maintaining the gated-tanh nonlinearities, residual connections, and skip connections.

In one or more embodiments, the filter sizes may be set to 3 for both height and width dimensions, and, non-causal convolutions may be used on width dimension, setting the dilation cycle as $[1, 2, 4, \ldots, 2^7]$. The convolutions on height dimension may be causal with the autoregressive constraint, and their dilation cycle should be carefully designed. In one or more embodiments, the dilations of 8 layers should be set as $d=[1, 2, \ldots, 2^s, 1, 2, \ldots, 2^s, \ldots]$, where $s \leq 7$. In one or more embodiments, the receptive field r over the height dimension should be larger than or equal to height h to prevent introducing unnecessary conditional independence and lowering likelihood. Table 2, for example, shows the test log-likelihoods (LLs) of WaveFlow with different dilation cycles on the height dimension when h=32. The models are stacked with 8 flows and each flow has 8 layers.

TABLE 2

| Model | Res. channels | Dilations d | Receptive field r | Test LLs |
|---|---|---|---|---|
| WaveFlow (h = 32) | 128 | 1, 1, 1, 1, 1, 1, 1, 1 | 17 | 4.960 |
| WaveFlow (h = 32) | 128 | 1, 2, 4, 1, 2, 4, 1, 2 | 35 | 5.055 |

It is noted that the receptive field of a stack of dilated convolutional layers may be expressed as: $r=(k-1)\times\Sigma_i d_i+1$, where k is the filter size and $d_i$ is the dilation at i-th layer. Thus, the sum of dilations should satisfy:

$$\sum_i d_i \geq \frac{h-1}{k-1}.$$

In one or more embodiments, when h is larger than or equal to $2^8=512$, the dilation cycle may be set as $[1, 2, 4, \ldots, 2^7]$. In one or more embodiments, when r has already been larger than h, the convolutions with smaller dilations may be used to provide larger likelihood.

Table 3 summarizes heights and preferred dilations used in experiments. The height h, filter size k over the height dimension, and the corresponding dilations are shown. It is noted that the receptive fields r are only slightly larger than heights h.

TABLE 3

| h | k | Dilations d | Receptive field r |
|---|---|---|---|
| 8 | 3 | 1, 1, 1, 1, 1, 1, 1, 1 | 17 |
| 16 | 3 | 1, 1, 1, 1, 1, 1, 1, 1 | 17 |
| 32 | 3 | 1, 2, 4, 1, 2, 4, 1, 2 | 35 |
| 64 | 3 | 1, 2, 4, 8, 16, 1, 2, 4 | 77 |

In one or more embodiments, a convolution queue may be implemented to cache intermediate hidden states to speed up the autoregressive inference over the height dimension. It is noted that WaveFlow may be fully autoregressive when x is squeezed by its length (i.e., h=n) and the filter size is set as 1 over the width dimension. If x is squeezed by h=2 and the filter size is set to 1 on height dimension, WaveFlow becomes a bipartite flow.

3. Local Conditioning for Speech Synthesis

In neural speech synthesis, a neural vocoder (e.g., WaveNet) synthesizes the time-domain waveforms, which can be conditioned on linguistic features, the mel spectrograms from a text-to-spectrogram model, or the learned hidden representation within a text-to-wave architecture. In one or more embodiments, WaveFlow is tested by conditioning it on ground-truth mel spectrograms upsampled to the same length as waveform samples with transposed 2D convolutions. To be aligned with the waveform, they are squeezed to the shape c×h×w, where c is the input channel dimension (e.g., mel bands). In one or more embodiments, after a 1×1 convolution mapping of the input channels to residual channels, they may be added as a bias term at each layer.

4. Stacking Multiple Flows with Permutations on Height Dimension

Flow-based models use a series of transformations until the distribution p(X) reaches a desired level of capacity. We denote $X=Z^{(n)}$ and repeatedly apply the transformation $Z^{(i-1)}=f^{-1}(Z^{(i)};\Theta^{(i)})$ defined in Eq. (6) from $Z^{(n)}$ to $Z^{(0)}$, where $Z^{(0)}$ are from the isotropic Gaussian. Thus, p(X) can be evaluated by applying the chain rule:

$$p(X) = p(Z^{(0)})\prod_{i=1}^{n}\left|\det\left(\frac{\partial f^{-1}(Z^{(i)};\Theta^{(i)})}{\partial Z^{(i)}}\right)\right|$$

In one or more embodiments, permuting each $Z^{(i)}$ over its height dimension after each transformation significantly improves the likelihood scores. In particular, two permutation strategies were tested for WaveFlow models stacked with 8 flows (i.e., $X=Z^{(8)}$) in Table 4. The models comprise flows and each flow has 8 convolutional layers with filter sizes 3. Table 4 illustrates the test LLs of WaveFlow with different permutation strategies: a) each $Z^{(i)}$ is reversed over the height dimension after each transformation, and b) $Z^{(7)}$, $Z^{(6)}$, $Z^{(5)}$, $Z^{(4)}$ were reversed over the height dimension, but with bipartition $Z^{(3)}$, $Z^{(2)}$, $Z^{(1)}$, $Z^{(0)}$ in the middle of the height dimension and then reversing each part respectively, e.g., after bipartition and reversing, the height dimension $$\left[0, \cdots, \frac{h}{2}-1, \frac{h}{2}, \cdots, h-1\right]$$

becomes $$\left[\frac{h}{2}-1, \cdots, 0, h-1, \frac{h}{2}\right].$$

In speech synthesis, one needs to permute the conditioner accordingly over the height dimension, which is aligned with $Z^{(i)}$. In Table 4, both strategies a) and b) significantly outperform the model without permutations mainly because of bidirectional modeling. Strategy b) outperforms a), which may be attributed to diverse autoregressive orders.

TABLE 4

| Model | Resid. channels | Permutation strategy | Test LLs |
|---|---|---|---|
| WaveFlow (h = 16) | 64 | none | 4.551 |
| WaveFlow (h = 16) | 64 | a) 8 reverse | 4.954 |
| WaveFlow (h = 16) | 64 | b) 4 reverse, 4 bipartition & reverse | 4.971 |

5. Related Work

Neural speech synthesis has obtained state-of-the-art results and received a lot of attention. Several neural TTS systems have been introduced, including WaveNet, Deep Voice 1 & 2 & 3, Tacotron 1 & 2, Char2Wav, VoiceLoop, WaveRNN, ClariNet, Transformer TTS, ParaNet, and FastSpeech.

Neural vocoders (waveform synthesizer), such as WaveNet, play the most important role in recent advances of speech synthesis. State-of-the-art neural vocoders are autoregressive models. Some have advocated for speeding up their sequential generation process. In particular, Subscale WaveRNN folds a long waveform sequence $x_{1:n}$ into a batch of shorter sequences and can produce up to 16 samples per step, thus, it requires at least $$\frac{n}{16}$$

steps to generate the whole audio. In contrast, in one or more embodiments, WaveFlow may generate $x_{1:n}$ within, e.g., 16 steps.

Flow-based models can either represent the approximate posteriors for variational inference, or, as in one or more embodiments presented herein, they may be trained directly on data using the change of variables formula. Glow can extend RealNVP with invertible 1×1 convolution on channel dimension, which first generates high-fidelity images. Some approaches generalize the invertible convolution to operate on both channels and spatial axes. Flow-based models have been successfully applied for parallel waveform synthesis with comparable fidelity as autoregressive models. Among these models, WaveGlow and FloWaveNet have a simple training pipeline as they solely use the maximum likelihood objective. However, both approaches are less expressive than autoregressive models as indicated by their large footprint and lower likelihood scores.

D. Experiment

Likelihood-based generative models for raw audio are compared in term of test likelihood, audio fidelity, and synthesis speed.

Data: The U speech dataset containing about 24 hours of audio with a sampling rate of 22.05 kHz recorded on a MacBook Pro in a home environment is used. It consists of 13, 100 audio clips from a single female speaker.

Models: Several likelihood-based models are evaluated, including WaveFlow, Gaussian WaveNet, WaveGlow, and autoregressive flow (AF). As illustrated in Section C.2, AF is implemented from WaveFlow by squeezing the waveforms by length and setting the filter size as 1 over width dimension. Both WaveNet and AF have 30 layers with dilation cycle [1, 2, . . . , 512] and filter size 3. For WaveFlow and WaveGlow, investigate different setups are investigated, including the number of flows, size of residual channels, and squeezed height h.

Conditioner: The 80-band mel spectrogram of the original audio is used as the conditioner for WaveNet, WaveGlow, and WaveFlow. FFT size is set to 1024, hop size to 256, and window size to 1024. For WaveNet and WaveFlow, the mel conditioner is upsampled 256 times by applying two layers of transposed 2D convolution (in time and frequency) interleaved with leaky ReLU ($\alpha$=0.4). The upsampling strides in time are 16 and the 2D convolution filter sizes are [32, 3] for both layers. For WaveGlow, embodiments may directly use the open source implementation.

Training: All models are trained on 8 Nvidia 1080Ti GPUs using randomly chosen short clips of 16,000 samples from each utterance. For WaveFlow and WaveNet, the Adam optimizer is used with a batch size of 8 and a constant learning rate of $2\times10^{-4}$. For WaveGlow, the Adam optimizer is used with a batch size of 16 and a learning rate of $1\times10^{-4}$. Weight normalization is applied whenever possible.

1. Likelihood

The test LLs of WaveFlow, WaveNet, WaveGlow and autoregressive flow (AF) are evaluated conditioned on mel spectrograms at 1M training steps. 1M steps are chosen as the cut-off, because the LLs decrease slowly after that, and it took one month to train the largest WaveGlow (residual channels=512) for 1M steps. The results are summarized in Table 5, which illustrates the test LLs of all models (row (a) to (t)) conditioned on mel spectrograms. For a x b=c in the "flows×layers" column, a is number of flows, b is number of layers in each flow, and c is the total number of layers. In WaveFlow, h is the squeezed height. Models with bolded test LLs are mentioned in the following observations:

1. Stacking a large number of flows improves LLs for all flow-based models. For example, WaveFlow (m) with 8 flows provides larger LL than WaveFlow (l) with 6 flows. The autoregressive flow (b) obtains the highest likelihood and outperforms WaveNet (a) with the same amount of parameters. Indeed, AF provides bidirectional modeling by stacking 3 flows with reverse operations.

2. WaveFlow has much larger likelihood than WaveGlow with comparable number of parameters. In particular, a small-foot print WaveFlow (k) has only 5.91M parameters but can provide comparable likelihood (5.023 vs. 5.026) as the largest WaveGlow (g) with 268.29M parameters.

3. As his increased, the likelihood of WaveFlow steadily increases, as can be seen from (h)-(k), and its inference will be slower on GPU with more sequential steps. In the limit, it is equivalent to an AF. This illustrates a trade-off between model capacity and inference parallelism.

4. WaveFlow (r) with 128 residual channels can obtain comparable likelihood (5.055 vs 5.059) as WaveNet (a) with 128 residual channels. A larger WaveFlow (t) with 256 residual channels can obtain even larger likelihood than WaveNet (5.101 vs 5.059).

It is noted that a significant likelihood gap that has so far existed between autoregressive models and flow-based models providing efficient sampling. In one or more embodiments, WaveFlow may close the likelihood gap with a relatively modest squeezing of height h, which suggests that the strength of autoregressive model is mainly at modeling the local structure of the signal.

TABLE 5

| | Model | flows × layers | Res. channels | # Param. | Test LLs |
|---|---|---|---|---|---|
| (a) | Gaussian WaveNet | 1 × 30 = 30 | 128 | 4.57M | **5.059** |
| (b) | Autoregressive flow | 3 × 10 = 30 | 128 | 4.54M | **5.161** |
| (c) | WaveGlow | 12 × 8 = 96 | 64 | 17.59M | 4.804 |
| (d) | WaveGlow | 12 × 8 = 96 | 128 | 34.83M | 4.927 |
| (e) | WaveGlow | 6 × 8 = 48 | 256 | 47.22M | 4.922 |
| (f) | WaveGlow | 12 × 8 = 96 | 256 | 87.88M | 5.018 |
| (g) | WaveGlow | 12 × 8 = 96 | 512 | 268.29M | **5.026** |
| (h) | WaveFlow (h = 8) | 8 × 8 = 64 | 64 | 5.91M | 4.935 |
| (i) | WaveFlow (h = 16) | 8 × 8 = 64 | 64 | 5.91M | 4.954 |
| (j) | WaveFlow (h = 32) | 8 × 8 = 64 | 64 | 5.91M | 5.002 |
| (k) | WaveFlow (h = 64) | 8 × 8 = 64 | 64 | 5.91M | **5.023** |
| (l) | WaveFlow (h = 8) | 6 × 8 = 48 | 96 | 9.58M | 4.946 |
| (m) | WaveFlow (h = 8) | 8 × 8 = 64 | 96 | 12.78M | 4.977 |
| (n) | WaveFlow (h = 16) | 8 × 8 = 64 | 96 | 12.78M | 5.007 |
| (o) | WaveFlow (h = 16) | 6 × 8 = 48 | 128 | 16.69M | 4.990 |
| (p) | WaveFlow (h = 8) | 8 × 8 = 64 | 128 | 22.25M | 5.009 |
| (q) | WaveFlow (h = 16) | 8 × 8 = 64 | 128 | 22.25M | 5.028 |
| (r) | WaveFlow (h = 32) | 8 × 8 = 64 | 128 | 22.25M | **5.055** |
| (s) | WaveFlow (h = 16) | 6 × 8 = 48 | 256 | 64.64M | 5.064 |
| (t) | WaveFlow (h = 16) | 8 × 8 = 64 | 256 | 86.18M | **5.101** |

2. Audio Fidelity and Synthesis Speed

In one or more embodiments, the permutation strategy b) described in Table 4 is used for WaveFlow. WaveNet is trained for 1M steps. Large WaveGlow and WaveFlow (res. channels 256 and 512) are trained for 1M steps due to practical time constraints. Moderate size models (res. channels 128) are trained for 2M steps. Small size models (res. channels 64 and 96) are trained for 3M steps with slightly improved performance after 2M steps. For ClariNet, the same setting as in *ClariNet: Parallel wave generation in end-to-end text-to-speech*, Ping, W., Peng, K., and Chen, J., ICLR (2019) is used. At synthesis, Z is sampled from an isotropic Gaussian with standard deviation 1.0 and 0.6 (default) for WaveFlow and WaveGlow, respectively. The crowdMOS toolkit is used for speech quality evaluation, where test utterances from these models were presented to workers on Mechanical Turk. In addition, the synthesis speed is tested on an NVIDIA V100 GPU without using any engineered inference kernels. For WaveFlow and WaveGlow, synthesis is run under NVIDIA Apex with 16-bit floating point (FP16) arithmetic, which does not introduce any degradation of audio fidelity and results in about a 2× speedup. Convolution queue is implemented in Python to cache the intermediate hidden states in WaveFlow for autoregressive inference over the height dimension, which results in an additional 3× to 5× speedup depending on height h.

The 5-scale MOS with 95% confidence intervals, synthesis speed over real-time, and model footprint are shown in Table 6 (audio samples are available at https://waveflow-demo.github.io). The following observations are drawn:

1. The small WaveFlow (res. channels 64) has 5.91M parameters and can synthesize 22.05 kHz high-fidelity speech (MOS: 4.32) 42.6× faster than real-time. In contrast, the speech quality of small WaveGlow (res. channels 64) is significantly worse (MOS: 2.17). Indeed, WaveGlow (res. channels 256) requires 87.88M parameters for generating high-fidelity speech.

2. The large WaveFlow (res. channels 256) outperforms the same size WaveGlow in terms of speech fidelity (MOS: 4.43 vs. 4.34). It also matches the state-of-the-art WaveNet, while generating speech 8.42× faster than real-time, because it only requires 128 sequential steps (number of flows× height h) to synthesize very long waveforms with hundreds of thousands time-steps.

3. ClariNet has the smallest footprint and provides reasonably good speech fidelity (MOS: 4.22) because of its "mode seeking" behavior. In contrast, likelihood-based models are forced to model all possible variations that exist in the data, which can lead to higher fidelity samples as long as they have enough model capacity.

Figure 3A:
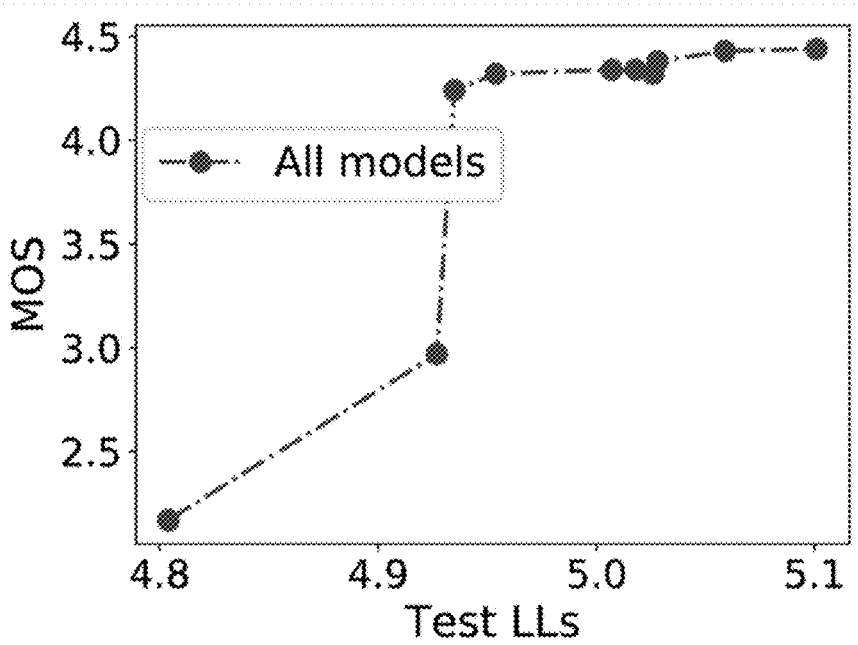
FIGS. 3A and 3B depict test log-likelihoods (LLs) vs. MOS scores for likelihood-based models in Table 6 according to one or more embodiments of the present disclosure.
Figure 3B:
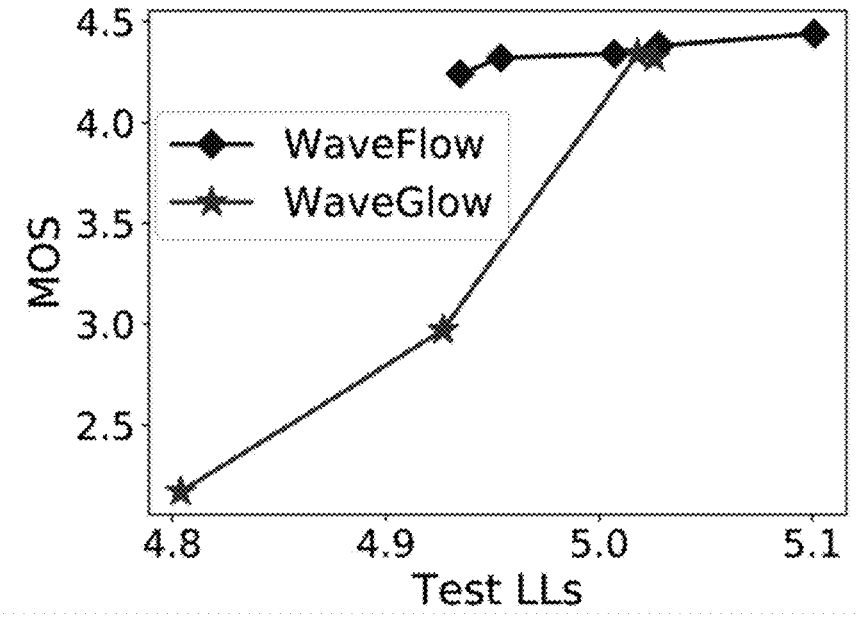

Further, FIGS. 3A and 3B depict test log-likelihoods (LLs) vs. MOS scores for likelihood-based models in Table 6 according to one or more embodiments of the present disclosure. The larger LLs roughly correspond to higher MOS scores even when we compare all models. This correlation becomes even more evident when we consider each model separately. It suggests that one may use the likelihood score as an objective measure for model selection.

TABLE 6

| Model | flows × layers | Res. channels | # Param. | Syn. Speed | MOS |
|---|---|---|---|---|---|
| Gaussian WaveNet | 1 × 30 = 30 | 128 | 4.57M | 0.002× | **4.43 ± 0.14** |
| ClariNet | 6 × 10 = 60 | 64 | 2.17M | 21.64× | 4.22 ± 0.15 |
| WaveGlow | 12 × 8 = 96 | 64 | 17.59M | 93.53× | 2.17 ± 0.13 |
| WaveGlow | 12 × 8 = 96 | 128 | 34.83M | 69.88× | 2.97 ± 0.15 |
| WaveGlow | 12 × 8 = 96 | 256 | **87.88M** | **34.69×** | **4.34 ± 0.11** |
| WaveGlow | 12 × 8 = 96 | 512 | 268.29M | 8.08× | 4.32 ± 0.12 |
| WaveFlow (h = 8) | 8 × 8 = 64 | 64 | 5.91M | 47.61× | 4.26 ± 0.12 |
| WaveFlow (h = 16) | 8 × 8 = 64 | 64 | **5.91M** | **42.60×** | **4.32 ± 0.08** |
| WaveFlow (h = 16) | 8 × 8 = 64 | 96 | 12.78M | 26.23× | 4.34 ± 0.13 |
| WaveFlow (h = 16) | 8 × 8 = 64 | 128 | 22.25M | 21.32× | 4.38 ± 0.09 |
| WaveFlow (h = 16) | 8 × 8 = 64 | 256 | 86.18M | 8.42× | **4.43 ± 0.10** |
| Ground-truth | — | — | — | — | 4.56 ± 0.09 |

3. Text-to-Speech

WaveFlow is also tested for text-to-speech on a proprietary dataset for convenience reasons. The dataset comprises 20 hours of audio from a female speaker with a sampling rate of 24 kHz. Deep Voice 3 (DV3) is used to predict mel spectrograms from text. A 20-layer WaveNet (res. channel=256, #param=9.08 M), WaveGlow (#param=87.88 M), and WaveFlow (h=16, #param=5.91 M) are trained and conditioned on teacher-forced mel spectrograms from DV3. As used herein, DV3 refers to one or more embodiments in U.S. patent application Ser. No. 16/058,265, filed on Aug. 8, 2018, entitled "SYSTEMS AND METHODS FOR NEURAL TEXT-TO-SPEECH USING CONVOLUTIONAL SEQUENCE LEARNING," and listing Sercan O. Arik, Wei Ping, Kainan Peng, Sharan Narang, Ajay Kannan, Andrew Gibiansky, Jonathan Raiman, and John Miller as inventors. For WaveGlow, the denoising function is applied with strength 0.1 in the repository to alleviate the constant frequency noise in synthesized audio. For WaveFlow, Z is sampled from isotropic Gaussian with standard deviation 0.95 to counteract the mismatch of mel conditioners between teacher-forced training and autoregressive inference from DV3. The MOS ratings with 95% confidence intervals in text-to-speech experiments are shown in Table 7.

TABLE 7

| Method | MOS |
|---|---|
| Deep Voice 3 + WaveNet | 4.21 ± 0.08 |
| Deep Voice 3 + WaveGlow | 3.98 ± 0.11 |
| Deep Voice 3 + WaveFlow | 4.17 ± 0.09 |

As the results indicate, WaveFlow is a very compelling neural vocoder that features i) simple likelihood-based training, ii) high-fidelity & ultra-fast synthesis, and iii) a small-memory footprint.

E. Discussion

Parallel WaveNet and ClariNet minimize the reverse KL divergence (KLD) between the student and teacher models in probability density distillation, which has the "mode seeking" behavior and may lead to whisper voices in practice. As a result, several auxiliary losses are introduced to alleviate the problem, including STFT loss, perceptual loss, contrastive loss and adversarial loss. In practice, this complicates system tuning and increases the cost of development. Since a small-footprint model does not need to model the numerous modes in real data distribution, it can generate good quality speech, e.g., when auxiliary losses are carefully tuned. It is worth mentioning that GAN-based models also exhibit similar "mode seeking" behavior for speech synthesis. In contrast, likelihood-based models, such as WaveFlow, WaveGlow, and WaveNet, minimize the forward KLD between the model and data distribution. Because the model learns all possible modes within the real data, the synthesized audio can be very realistic assuming sufficient model capacity. However, when a model does not have enough capacity, its performance may degrade quickly due to the "mode seeking" behavior of forward KLD (e.g., WaveGlow with 128 res. channels).

Although audio signals are mostly dominated by low-frequency components (e.g., in terms of amplitude), human ears are very sensitive to high-frequency content. As a result, it is advantageous to accurately model the local variations of waveform for high-fidelity synthesis, which is a strength of autoregressive models. However, autoregressive models are less efficient at modeling long-range correlations, which can be seen from the difficulties to generate globally consistent images. Worse still, they are also noticeably slow at synthesis. Non-autoregressive convolutional architectures can perform rapid synthesis and easily capture the long-range structure in the data, but this may generate spurious high-frequency components that decrease audio fidelity. In contrast, WaveFlow compactly models the local variations using short-range autoregressive functions and handles the long-range correlations with a non-autoregressive convolutional architecture, thereby, obtaining the best of both worlds.

F. Computing System Embodiments

In one or more embodiments, aspects of the present patent document may be directed to, may include, or may be implemented on one or more information handling systems (or computing systems). An information handling system/computing system may include any instrumentality or aggregate of instrumentalities operable to compute, calculate, determine, classify, process, transmit, receive, retrieve, originate, route, switch, store, display, communicate, manifest, detect, record, reproduce, handle, or utilize any form of information, intelligence, or data. For example, a computing system may be or may include a personal computer (e.g., laptop), tablet computer, mobile device (e.g., personal digital assistant (PDA), smart phone, phablet, tablet, etc.), smart watch, server (e.g., blade server or rack server), a network storage device, camera, or any other suitable device and may vary in size, shape, performance, functionality, and price. The computing system may include random access memory (RAM), one or more processing resources such as a central processing unit (CPU) or hardware or software control logic, read only memory (ROM), and/or other types of memory. Additional components of the computing system may include one or more disk drives, one or more network ports for communicating with external devices as well as various input and output (I/O) devices, such as a keyboard, mouse, stylus, touchscreen, and/or video display. The computing system may also include one or more buses operable to transmit communications between the various hardware components.

Figure 4:
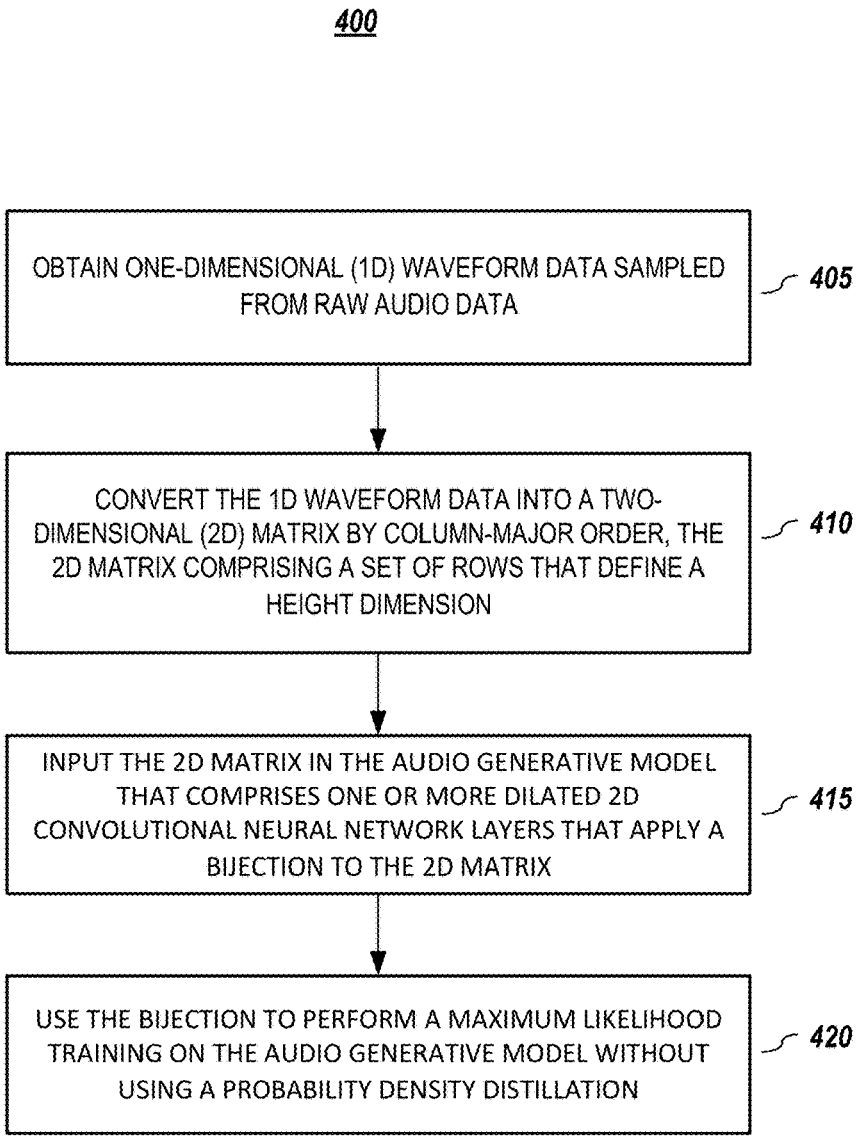
FIG. 4 is a flowchart for training an audio generative model according to one or more embodiments of the present disclosure.
Figure 5:
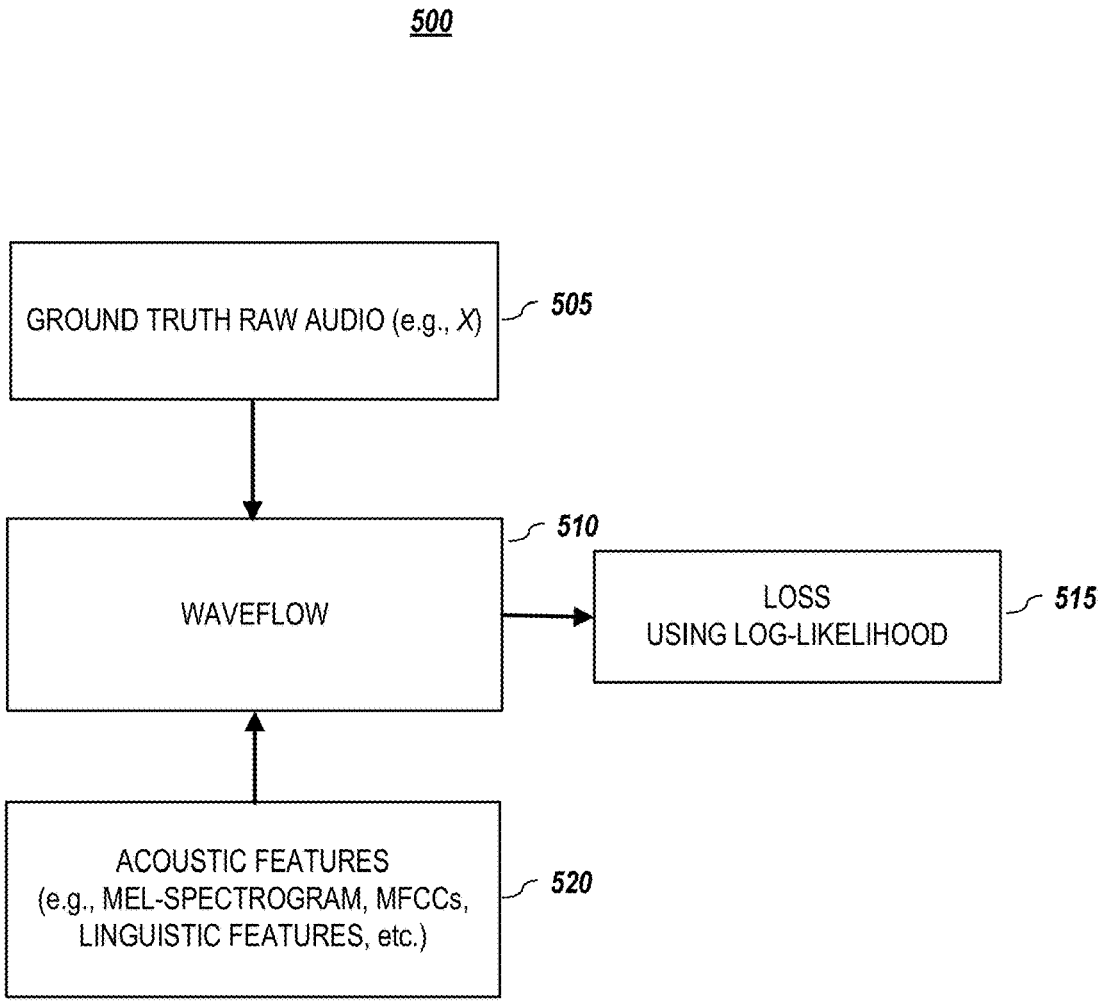
FIG. 5 depicts a simplified system diagram for likelihood-based training for modeling raw audio according to one or more embodiments of the present disclosure.

FIG. 4 is a flowchart for training an audio generative model, according to one or more embodiments of the present disclosure. In one or more embodiments, process 400 for modeling raw audio may begin when 1D waveform data that has been sampled from raw audio data is obtained (405). The 1D waveform data may be converted (410) into a 2D matrix, e.g., by column-major order. In one or more embodiments, the 2D matrix may comprise a set of rows that define a height dimension. The 2D matrix may be input (415) to the audio generative model that may comprise one or more dilated 2D convolutional neural network layers that apply a bijection to the 2D matrix. In one or more embodiments, the bijection may be used (420) to perform a maximum likelihood training on the audio generative model without using a probability density distillation FIG. 5 depicts a simplified system diagram for likelihood-based training for modeling raw audio according to one or more embodiments of the present disclosure. In embodiments, system 500 may comprise WaveFlow module 510, inputs 505 and 510, and output 515, e.g., a loss. Input 505 may comprise 1D waveform data that may be sampled from raw audio to serve as ground-truth data. Input 520 may comprise acoustic features, such as linguistic features, mel spectrograms, mel frequency cepstral coefficients (MFCCs), etc. It is understood that WaveFlow module 510 may comprise additional and/or other inputs and outputs than those depicted in FIG. 5. In one or more embodiments, WaveFlow module 510 may utilize one or more methods described herein to perform maximum likelihood training to generate output 515, e.g., by using variable $Z_{i,j}$ from Eq. (6) to calculate log-likelihood scores according to the loss function in Eq. (8) and output the loss.

Figure 6:
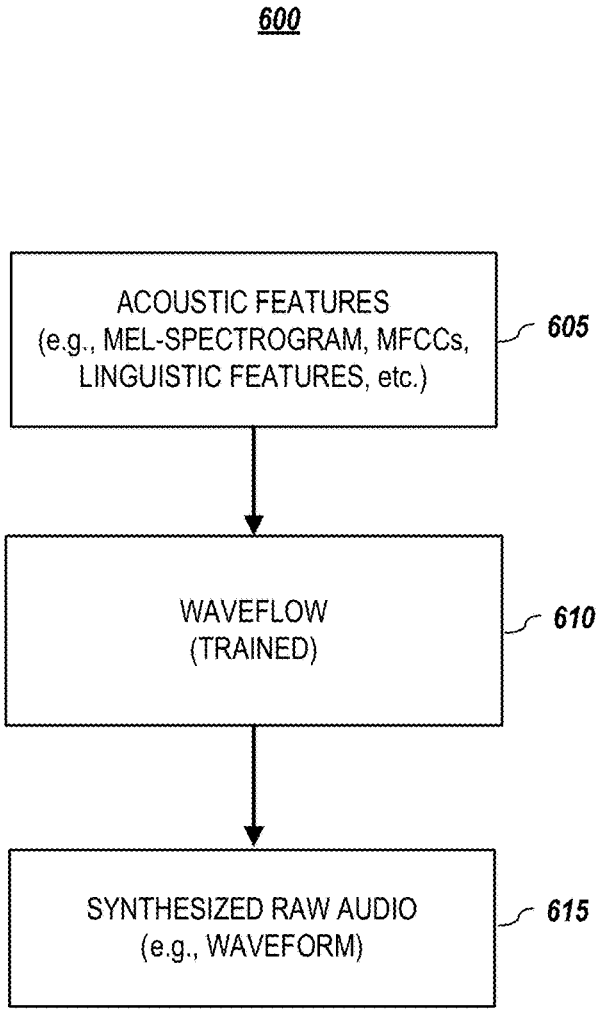
FIG. 6 depicts a simplified system diagram for modeling raw audio according to one or more embodiments of the present disclosure.

FIG. 6 depicts a simplified system diagram for modeling raw audio according to one or more embodiments of the present disclosure. In embodiments, system 600 may comprise WaveFlow module 610, input 605, and output 615. Input 605 may comprise acoustic features, such as linguistic features, mel spectrograms, MFCCs, etc., depending on the application (e.g., TTS, music, etc.). Output 615 comprises synthesized data, such as 1D waveform data. As with FIG. 5, it is understood that WaveFlow module 610 may comprise additional and/or other inputs and outputs than those depicted in FIG. 6. In one or more embodiments, WaveFlow module 610 may have been trained according to any of the methods discussed herein and may utilize one or more methods to generate output 615. As an example, WaveFlow module 610 may use Eq. (9) discussion in Section C above to predict output 615, e.g., a set of raw audio signals.

Figure 7:
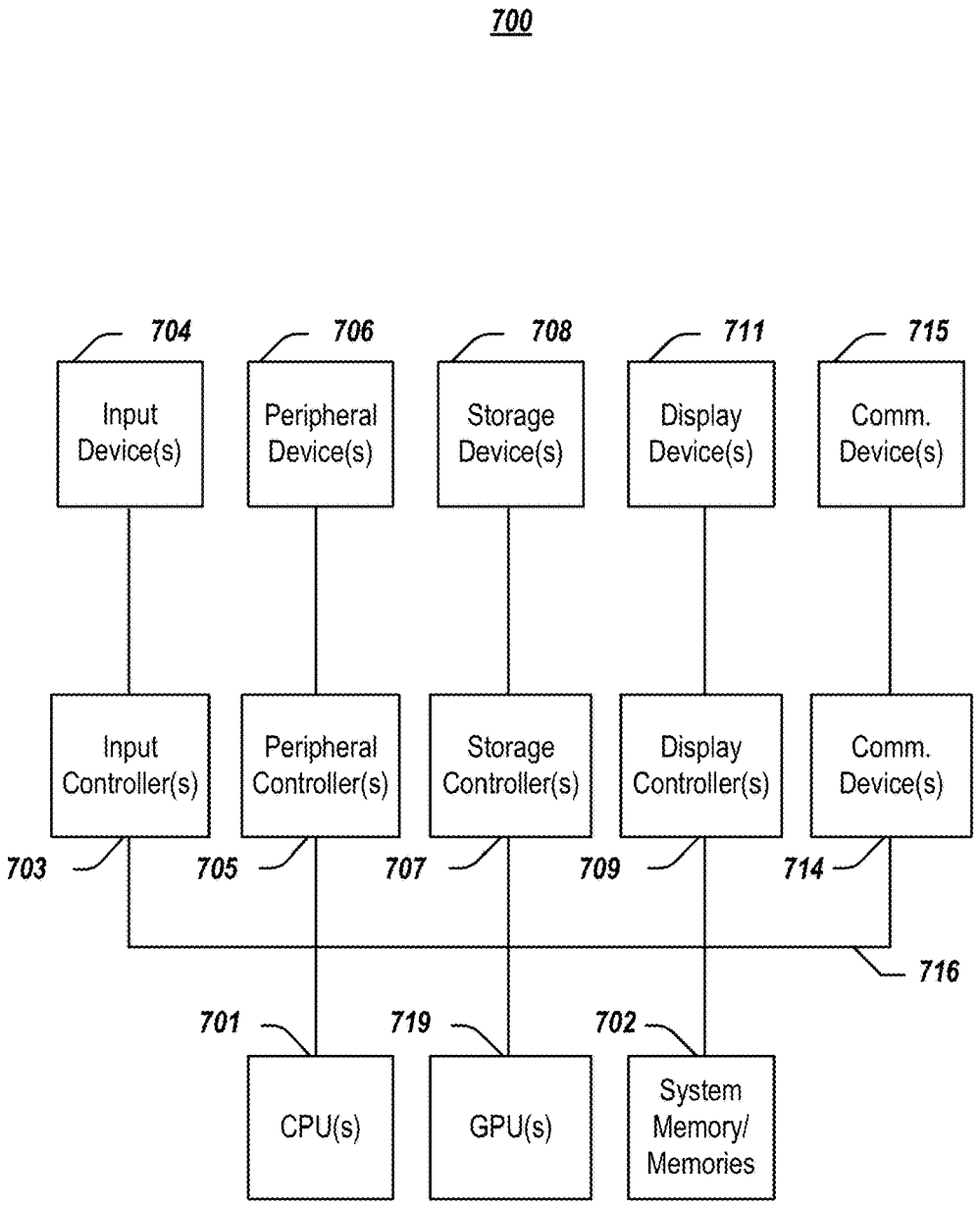
FIG. 7 depicts a simplified block diagram of a computing system, according to embodiments of the present disclosure.

FIG. 7 depicts a simplified block diagram of a computing system (or computing system), according to one or more embodiments of the present disclosure. It will be understood that the functionalities shown for system 700 may operate to support various embodiments of a computing system—although it shall be understood that a computing system may be differently configured and include different components, including having fewer or more components as depicted in FIG. 7.

As illustrated in FIG. 7, the computing system 700 includes one or more CPUs 701 that provides computing resources and controls the computer. CPU 701 may be implemented with a microprocessor or the like, and may also include one or more GPU 719 and/or a floating-point coprocessor for mathematical computations. In one or more embodiments, one or more GPUs 719 may be incorporated within the display controller 709, such as part of a graphics card or cards. The system 700 may also include a system memory 702, which may comprise RAM, ROM, or both.

A number of controllers and peripheral devices may also be provided, as shown in FIG. 7. An input controller 703 represents an interface to various input device(s) 704, such as a keyboard, mouse, touchscreen, and/or stylus. The computing system 700 may also include a storage controller 707 for interfacing with one or more storage devices 708 each of which includes a storage medium such as magnetic tape or disk, or an optical medium that might be used to record programs of instructions for operating systems, utilities, and applications, which may include one or more embodiments of programs that implement various aspects of the present disclosure. Storage device(s) 708 may also be used to store processed data or data to be processed in accordance with the disclosure. The system 700 may also include a display controller 709 for providing an interface to a display device 711, which may be a cathode ray tube (CRT) display, a thin film transistor (TFT) display, organic light-emitting diode, electroluminescent panel, plasma panel, or any other type of display. The computing system 700 may also include one or more peripheral controllers or interfaces 705 for one or more peripherals 706. Examples of peripherals may include one or more printers, scanners, input devices, output devices, sensors, and the like. A communications controller 714 may interface with one or more communication devices 715, which enables the system 700 to connect to remote devices through any of a variety of networks including the Internet, a cloud resource (e.g., an Ethernet cloud, a Fiber Channel over Ethernet (FCoE)/Data Center Bridging (DCB) cloud, etc.), a local area network (LAN), a wide area network (WAN), a storage area network (SAN) or through any suitable electromagnetic carrier signals including infrared signals.

In the illustrated system, all major system components may connect to a bus 716, which may represent more than one physical bus. However, various system components may or may not be in physical proximity to one another. For example, input data and/or output data may be remotely transmitted from one physical location to another. In addition, programs that implement various aspects of the disclosure may be accessed from a remote location (e.g., a server) over a network. Such data and/or programs may be conveyed through any of a variety of machine-readable medium including, for example: magnetic media such as hard disks, floppy disks, and magnetic tape; optical media such as compact disc (CD)-ROMs and holographic devices; magneto-optical media; and hardware devices that are specially configured to store or to store and execute program code, such as application specific integrated circuits (ASICs), programmable logic devices (PLDs), flash memory devices, other non-volatile memory (NVM) devices (such as 3D XPoint-based devices), and ROM and RAM devices.

Aspects of the present disclosure may be encoded upon one or more non-transitory computer-readable media with instructions for one or more processors or processing units to cause steps to be performed. It shall be noted that the one or more non-transitory computer-readable media shall include volatile and/or non-volatile memory. It shall be noted that alternative implementations are possible, including a hardware implementation or a software/hardware implementation. Hardware-implemented functions may be realized using ASIC(s), programmable arrays, digital signal processing circuitry, or the like. Accordingly, the "means" terms in any claims are intended to cover both software and hardware implementations. Similarly, the term "computer-readable medium or media" as used herein includes software and/or hardware having a program of instructions embodied thereon, or a combination thereof. With these implementation alternatives in mind, it is to be understood that the figures and accompanying description provide the functional information one skilled in the art would require to write program code (i.e., software) and/or to fabricate circuits (i.e., hardware) to perform the processing required.

It shall be noted that one or more embodiments of the present disclosure may further relate to computer products with a non-transitory, tangible computer-readable medium that have computer code thereon for performing various computer-implemented operations. The media and computer code may be those specially designed and constructed for the purposes of the present disclosure, or they may be of the kind known or available to those having skill in the relevant arts. Examples of tangible computer-readable media include, for example: magnetic media such as hard disks, floppy disks, and magnetic tape; optical media such as CD-ROMs and holographic devices; magneto-optical media; and hardware devices that are specially configured to store or to store and execute program code, such as ASICs, programmable logic devices (PLDs), flash memory devices, other NVM devices (such as 3D XPoint-based devices), and ROM and RAM devices. Examples of computer code include machine code, such as produced by a compiler, and files containing higher level code that are executed by a computer using an interpreter. One or more embodiments of the present disclosure may be implemented in whole or in part as machine-executable instructions that may be in program modules that are executed by a processing device. Examples of program modules include libraries, programs, routines, objects, components, and data structures. In distributed computing environments, program modules may be physically located in settings that are local, remote, or both.

One skilled in the art will recognize no computing system or programming language is critical to the practice of the present disclosure. One skilled in the art will also recognize that a number of the elements described above may be physically and/or functionally separated into modules and/or sub-modules or combined together.

It will be appreciated to those skilled in the art that the preceding examples and embodiments are exemplary and not limiting to the scope of the present disclosure. It is intended that all permutations, enhancements, equivalents, combinations, and improvements thereto that are apparent to those skilled in the art upon a reading of the specification and a study of the drawings are included within the true spirit and scope of the present disclosure. It shall also be noted that elements of any claims may be arranged differently including having multiple dependencies, configurations, and combinations.

What is claimed is:

1. A method for training an audio generative model, the method comprising:

obtaining one-dimensional (1D) waveform data obtained from raw audio data;

converting the 1D waveform data into a two-dimensional (2D) matrix by column-major order, wherein the 2D matrix comprising a set of rows that define a height dimension and the 1D waveform data obtained from the raw audio data comprises data elements having a temporal order and are positioned in the 2D matrix in a column according to the temporal order such that adjacent data elements in a column are in the same adjacent order as in the 1D waveform data;

inputting the 2D matrix in the audio generative model, the audio generative model comprising one or more dilated 2D convolutional neural network layers that apply a bijection to the 2D matrix; and performing maximum likelihood training on the audio generative model.

2. The method of claim 1, wherein the bijection comprises shifting variables and scaling variables that have been modeled by the one or more dilated 2D convolutional neural network layers.

3. The method of claim 1, further comprising, for two or more invertible transformations, in response to obtaining an output 2D matrix, permuting the output 2D matrix over the height dimension.

4. The method of claim 3, wherein permuting comprises at least one of, reversing, after each transformation, a height dimension of at least some elements in a sequence of transformations to increase model capacity, or splitting the sequence into two parts and separately reversing the height dimension for each part.

5. The method of claim 1, wherein the step of performing maximum likelihood training on the audio generative model is done without using probability density distillation.

6. The method of claim 1, wherein the bijection is an autoregressive transformation over the height dimension, the bijection causing an element in a first row to have an autoregressive dependency on one or more elements in at least one second row.

7. The method of claim 6, wherein converting the 1D waveform data into the 2D matrix maintains temporal order information when applying the autoregressive transformation to adjacent data elements in a column of the 2D matrix.

8. The method of claim 6, further comprising determining one or more 2D dilations to compute a receptive field over a number of the one or more 2D dilated convolutional neural network layers, the receptive field being equal or greater than the height dimension, wherein 2D dilations at two different convolutional neural network layers are different.

9. A system for modeling raw audio waveforms, the system comprising:

one or more processors; and a non-transitory computer-readable medium or media comprising one or more sets of instructions which, when executed by at least one of the one or more processors, causes steps to be performed comprising:

at an audio generative model that comprises one or more dilated 2D convolutional neural network layers, obtaining a set of acoustic features; and using the set of acoustic features to generate audio samples, wherein the audio generative model has been trained by performing steps comprising:

obtaining one-dimensional (1D) waveform data obtained from raw audio data;

converting the 1D waveform data into a two-dimensional (2D) matrix by column-major order, the 2D matrix comprising a set of rows that define a height dimension;

inputting the 2D matrix in the audio generative model that applies a bijection to the 2D matrix, in which the bijection is an autoregressive transformation over the height dimension and causes an element in a row of the 2D matrix to have an autoregressive dependency to elements in a previous row or previous rows of the 2D matrix, and wherein converting the 1D waveform data into the 2D matrix maintains temporal order information to adjacent waveform samples in a column of the 2D matrix; and performing maximum likelihood training on the audio generative model.

10. The system of claim 9, wherein the bijection has a triangular Jacobian and a determinant that is used to obtain a log-likelihood that serves as an objective function for the maximum likelihood training.

11. The system of claim 9, further comprising using a two-dimensional convolution queue to cache one or more intermediate hidden states to speed up audio generation.

12. The system of claim 9, wherein the bijection comprises a shifting term and a scaling term that have been modeled by the one or more dilated 2D convolutional neural network layers and wherein the 1D waveform data obtained from the raw audio data comprises data elements having a temporal order and are positioned in the 2D matrix according to the temporal order such that adjacent data elements in a column are in the same adjacent temporal order as in the 1D waveform data and wherein at least one of the scaling term and the shifting term receives, when computing a bijection for a data element, an input comprising the data elements in the rows in the 2D matrix: (1) above the row for that element, if the 2D matrix was filled in increasing temporal order going down a column, or (2) below the row for that data element, if the 2D matrix was filled in increasing temporal order going up a column.

13. The system of claim 9, further comprising, for two or more invertible transformations, in response to obtaining an output 2D matrix, permuting the output 2D matrix over the height dimension.

14. The system of claim 13, wherein permuting comprises at least one of, reversing, after each transformation, a height dimension of at least some elements in a sequence of transformations to increase model capacity, or splitting the sequence into two parts and separately reversing the height dimension for each part.

15. The system of claim 9, wherein the step of performing maximum likelihood training on the audio generative model is done without using probability density distillation.

16. A generative method for modeling raw audio waveforms, the method comprising:

at an audio generative model, obtaining a set of acoustic features; and using the set of acoustic features to generate audio samples, wherein the audio generative model has been trained by performing steps comprising:

one-dimensional (1D) waveform data obtained from raw audio data;

converting the 1D waveform data into a two-dimensional (2D) matrix by column-major order, the 2D matrix comprising a set of rows that define a height dimension;

inputting the 2D matrix in the audio generative model, the audio generative model comprising one or more dilated 2D convolutional neural network layers that apply a bijection to the 2D matrix, in which the bijection is an autoregressive transformation over the height dimension, the bijection causing an element in a row of the 2D matrix to have an autoregressive dependency on elements in a previous row or previous rows of the 2D matrix; and performing a maximum likelihood training on the audio generative model.

17. The method of claim 16 wherein the step of performing maximum likelihood training on the audio generative model is done without using probability density distillation.

18. The method of claim 16 wherein converting the 1D waveform data into the 2D matrix maintains temporal order information when applying the autoregressive transformation to adjacent waveform samples in a column of the 2D matrix.

19. The method of claim 16 wherein generating the audio samples comprises:

obtaining inverse transformation data from a density distribution; and applying to the inverse transformation data a forward mapping.

20. The method of claim 16 wherein the 1D waveform data obtained from the raw audio data comprises data elements having a temporal order and are positioned in the 2D matrix according to the temporal order such that adjacent data elements in a column are in the same adjacent temporal order as in the 1D waveform data and wherein the bijection comprises a scaling term and a shifting term in which at least one of the scaling term and the shifting term receives, when computing a bijection for a data element, an input comprising the data elements in the rows in the 2D matrix: (1) above the row for that element, if the 2D matrix was filled in increasing temporal order going down a column, or (2) below the row for that data element, if the 2D matrix was filled in increasing temporal order going up a column.

* * * * *